US008152572B1

(12) United States Patent
Liu

(10) Patent No.: US 8,152,572 B1
(45) Date of Patent: Apr. 10, 2012

(54) CONNECTOR WITH AN INSULATING BODY WITH A RECESS WITH A PROTRUSION FORMING AN ANNULAR GAP BETWEEN THE RECESS AND THE PROTRUSION

(76) Inventor: Yang-Ru Liu, Zhuqi Township, Chiayi County (TW)

( * ) Notice: Subject to any disclaimer, the term of this patent is extended or adjusted under 35 U.S.C. 154(b) by 0 days.

(21) Appl. No.: 13/049,054

(22) Filed: Mar. 16, 2011

(51) Int. Cl.
*H01R 13/432* (2006.01)

(52) U.S. Cl. ..... 439/746

(58) Field of Classification Search ..... 439/744–749
See application file for complete search history.

(56) References Cited

U.S. PATENT DOCUMENTS 4,834,678 A * 5/1989 Emadi et al. ..... 439/701
4,917,634 A * 4/1990 Geib et al. ..... 439/746
5,285,871 A * 2/1994 Sievenpiper ..... 184/7.4
6,247,974 B1 * 6/2001 Jenner et al. ..... 439/746
6,520,998 B1 * 2/2003 Scholler et al. ..... 439/851
7,048,596 B2 * 5/2006 Swearingen et al. ..... 439/843
7,255,611 B2 * 8/2007 Kubo et al. ..... 439/748
7,387,548 B2 * 6/2008 Takehara et al. ..... 439/843
7,862,354 B2 * 1/2011 Hughes et al. ..... 439/181
8,029,326 B2 * 10/2011 Rossman ..... 439/843
2009/0318034 A1 * 12/2009 Yavari et al. ..... 439/746

* cited by examiner

*Primary Examiner* — Chandrika Prasad

(57) ABSTRACT

A connector includes an insulation body having a recess defined in the first end thereof and a protrusion extends from the inner end of the recess to form an annular gap between the inner periphery of the recess and the protrusion. The protrusion has a connection hole defined therethrough and a shoulder is formed in the connection hole. A passage is defined in the second end of the insulation body and communicates with the connection hole. A conductive member is inserted into the connection hole and the passage. Multiple flexible plates extend inclinedly from the outer periphery of the conductive member and are engaged with the shoulder. The body is easily removed from the mold and the conductive member is securely connected to the insulation body.

10 Claims, 12 Drawing Sheets

CONNECTOR WITH AN INSULATING BODY WITH A RECESS WITH A PROTRUSION FORMING AN ANNULAR GAP BETWEEN THE RECESS AND THE PROTRUSION

BACKGROUND OF THE INVENTION (1) Field of the Invention

The present invention relates to a connector, and more particularly, to a connector securely combined with the electric cable.

(2) Description of the Prior Art

A conventional connector is shown in FIGS. 1 and 2, and generally includes an insulation body 10, a collar 11 and a terminal 12, wherein the insulation body 10 has a recess 13 defined in the rear end thereof and a passage 14 defined in the front end thereof. A connection hole 15 is located in communication between the recess 13 and the passage 14. An enlarged radial groove is formed in the inside of the connection hole 15 so as to form a shoulder 16. The collar 11 is located in the connection hole 15 and has multiple flexible plates 17 extending inclinedly at the rear end thereof so as to be engaged with the shoulder 16. Multiple resilient plates 18 extend from a periphery of the collar 11 and toward the front end of the collar 11. The terminal 12 extends through the collar and inserted into the passage 14. The terminal 12 has multiple engaging plates 19 extending inclinedly from the periphery thereof and toward the rear end of the terminal 12 so that the engaging plates 19 are engaged with the resilient plates 18.

However, the inner diameter of the connection hole 15 is slightly larger than that of the passage 14, and the shoulder 16 is directly formed on the inside of the connection hole 15, so that when the insulation body 10 is made by way of plastic injection molding, it is difficult to removed from the mold. The inside of the enlarged groove that forms the shoulder 16 is easily damaged and fails to position the collar 11. In order to easily remove the insulation body 10 from the mold, the manufacturers tend to make the shoulder 16 to protrude a limited radial thickness from the inside of the connection hole 15. Nevertheless, the thin shoulder 16 cannot firmly position the collar 11 and the terminal 12 is easily disengaged from the insulation body 10. Furthermore, because the shoulder 16 is directly formed on the wall of the connection hole 15, the thick wall of the insulation body 10 shrinks when the molding process is completely and the connection hole 15 and the shoulder 16 deform. The collar 11 is either difficult to be installed in the connection hole 15 or the flexible plates 17 of the collar 11 cannot be engaged with the shoulder 16.

The present invention intends to provide a connector wherein the insulation body is easily manufactured and the collar is firmly connected to the insulation body.

SUMMARY OF THE INVENTION

The present invention relates to a connector and comprises an insulation body having a recess defined in the first end thereof and a protrusion extends from the inner end of the recess to form an annular gap between the inner periphery of the recess and the protrusion such that the protrusion is expandable radially and outward. The protrusion has a connection hole defined therethrough and an enlarged groove is defined in a periphery of the connection hole so as to form a shoulder. A passage is defined in the second end of the insulation body and communicates with the connection hole. The inner diameter of the passage is smaller than that of the connection hole. A conductive member is inserted into the connection hole and the passage. Multiple flexible plates extend inclinedly from the outer periphery of the conductive member and are engaged with the shoulder.

In the invention, the conductive member can be a terminal or a combination of a collar and a terminal. The collar is located in the connection hole and the flexible plates extend inclinedly from the first end of the collar. Multiple resilient plates extend inclinedly from the periphery of the collar and toward the second end of the collar. The terminal has multiple engaging plates extending inclinedly from the periphery thereof and toward the first end of the terminal. When the terminal extends through the collar, the engaging plates are engaged with the resilient plates of the collar.

By the annular gap, the protrusion is expandable and can return to the initial position, so that the insulation body can easily removed from the mold by the adjustment of the protrusion. Also, a deeper enlarged groove can be made so that the flexible plates on the conductive member are firmly engaged with the shoulder. The annular gap and the connection hole have thinner wall which shrinks slightly so that the conductive member can easily be positioned and engaged within the connection hole.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
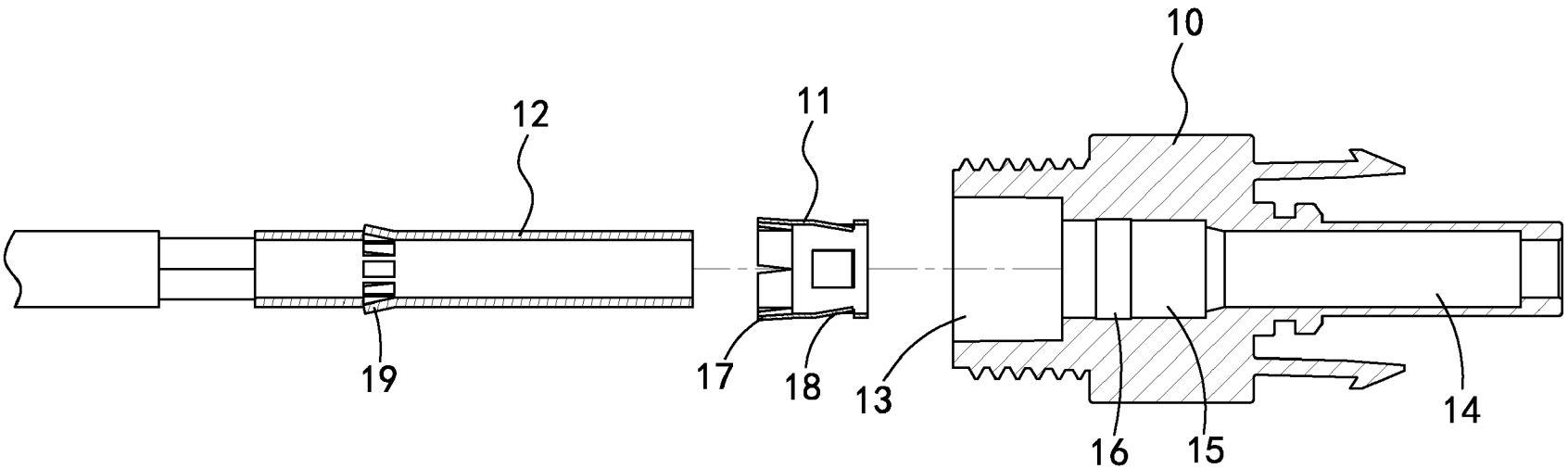
FIG.1 Prior Art
FIG. 1 is an exploded view to show the conventional connector.
Figure 2:
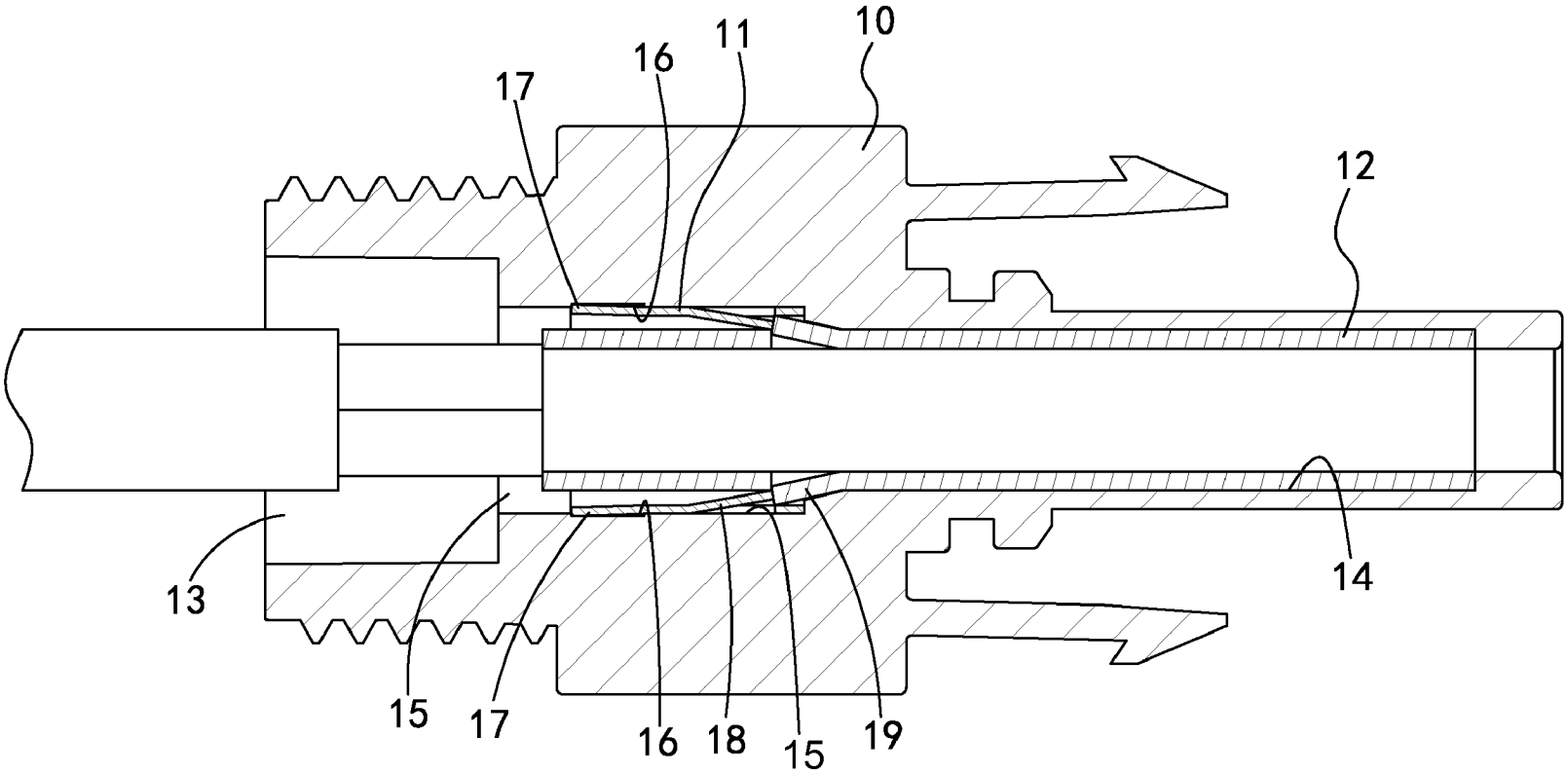
FIG.2 Prior Art
FIG. 2 is an enlarged cross sectional view the conventional connector.
Figure 3:
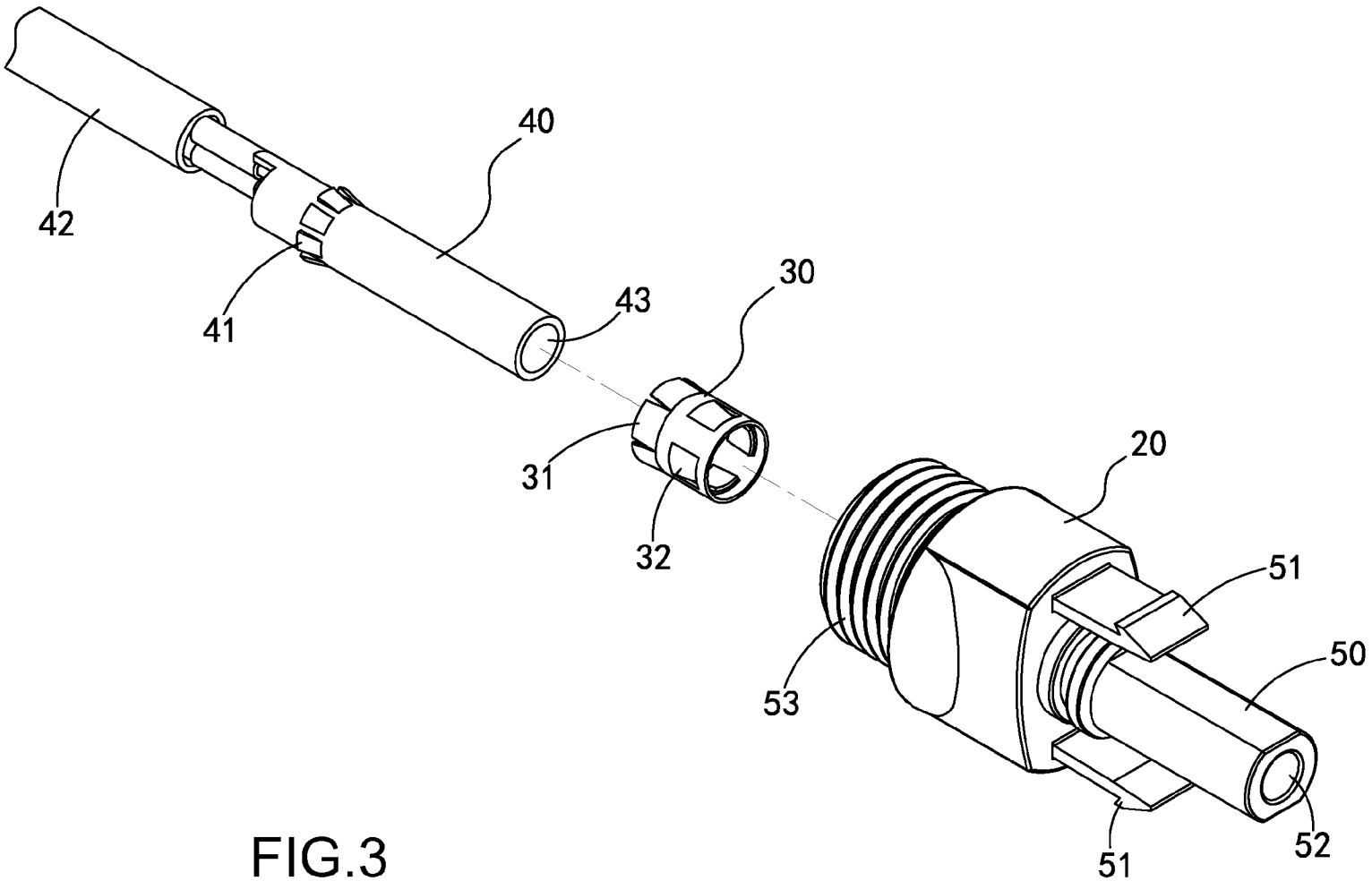
FIG. 3 is an exploded view to show the male connector of the present invention.
Figure 4:
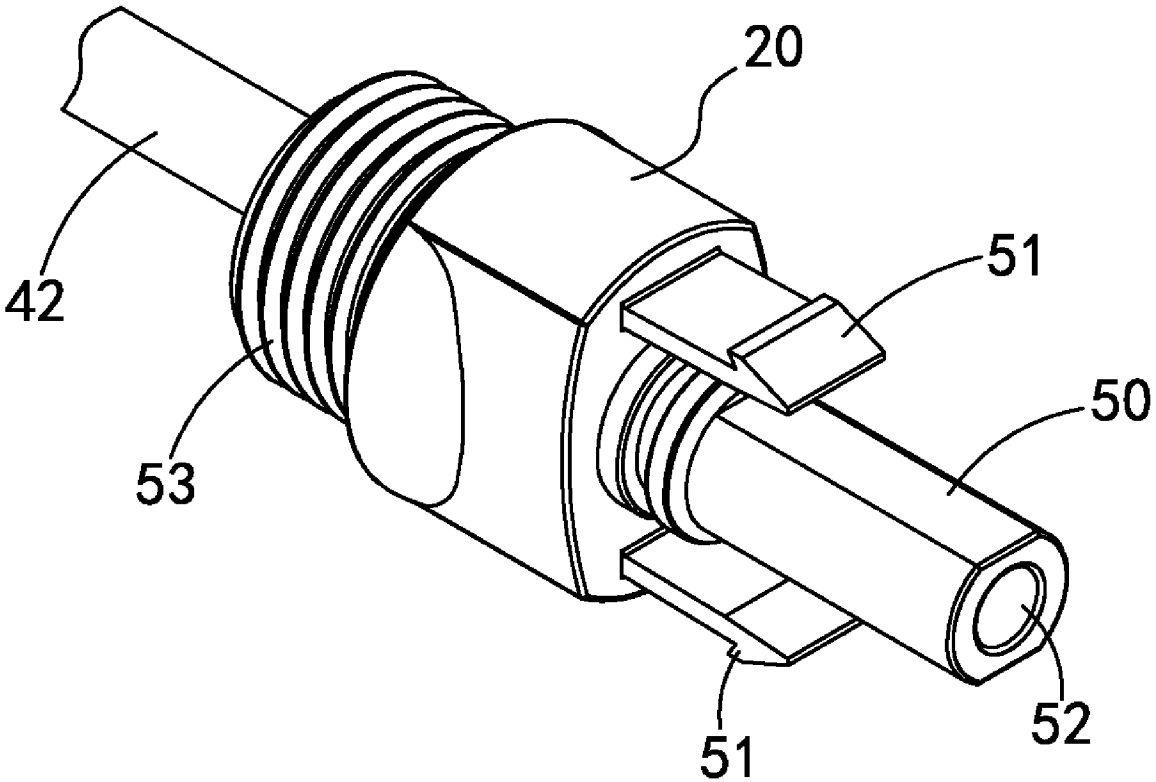
FIG. 4 is a perspective view to show the male connector of the present invention.
Figure 5:
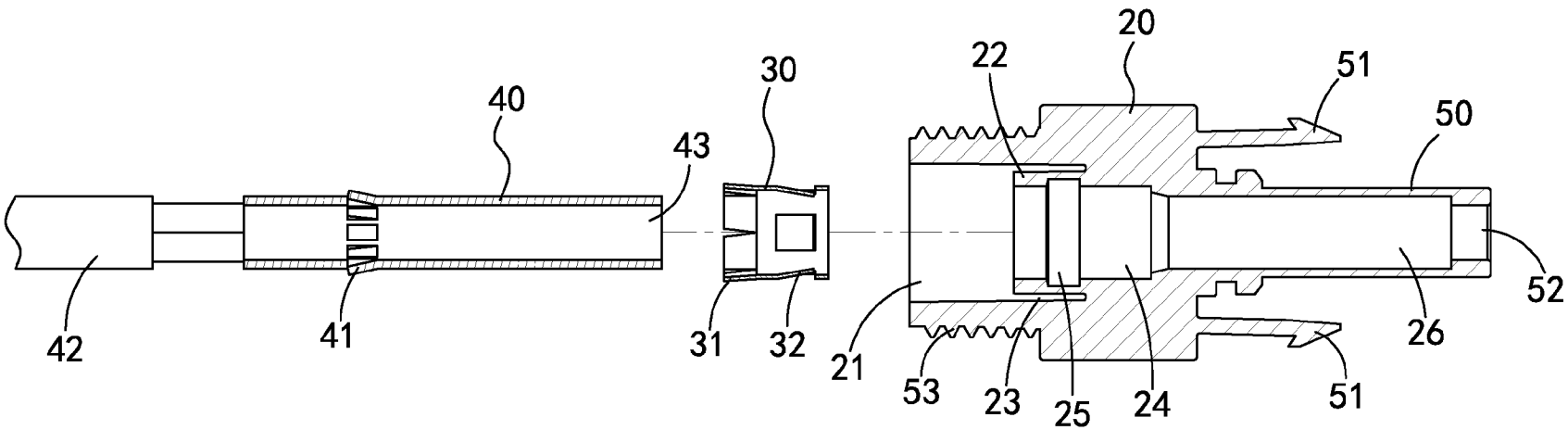
FIG. 5 is a cross sectional view to show the male connector of the present invention.
Figure 6:
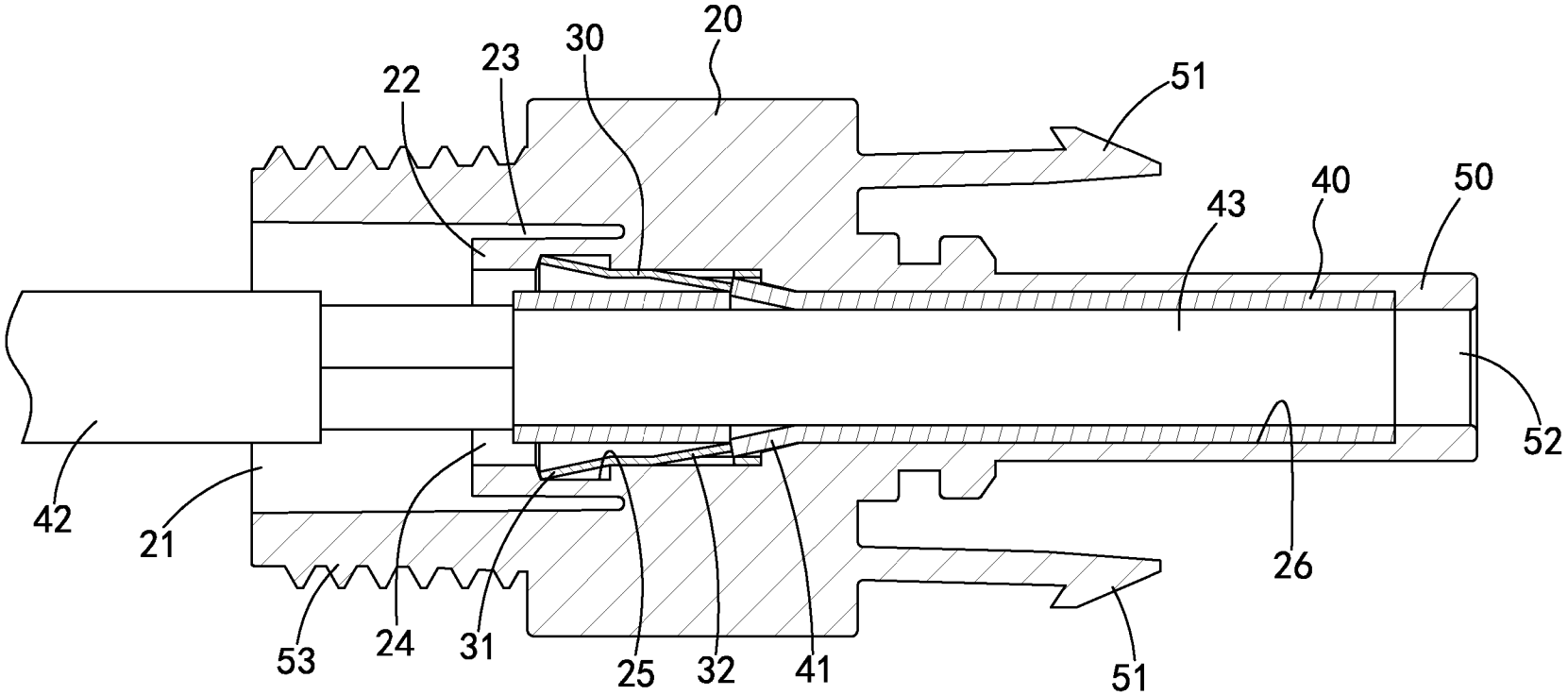
FIG. 6 is an enlarged cross sectional view of the male connector of the present invention.
Figure 7:
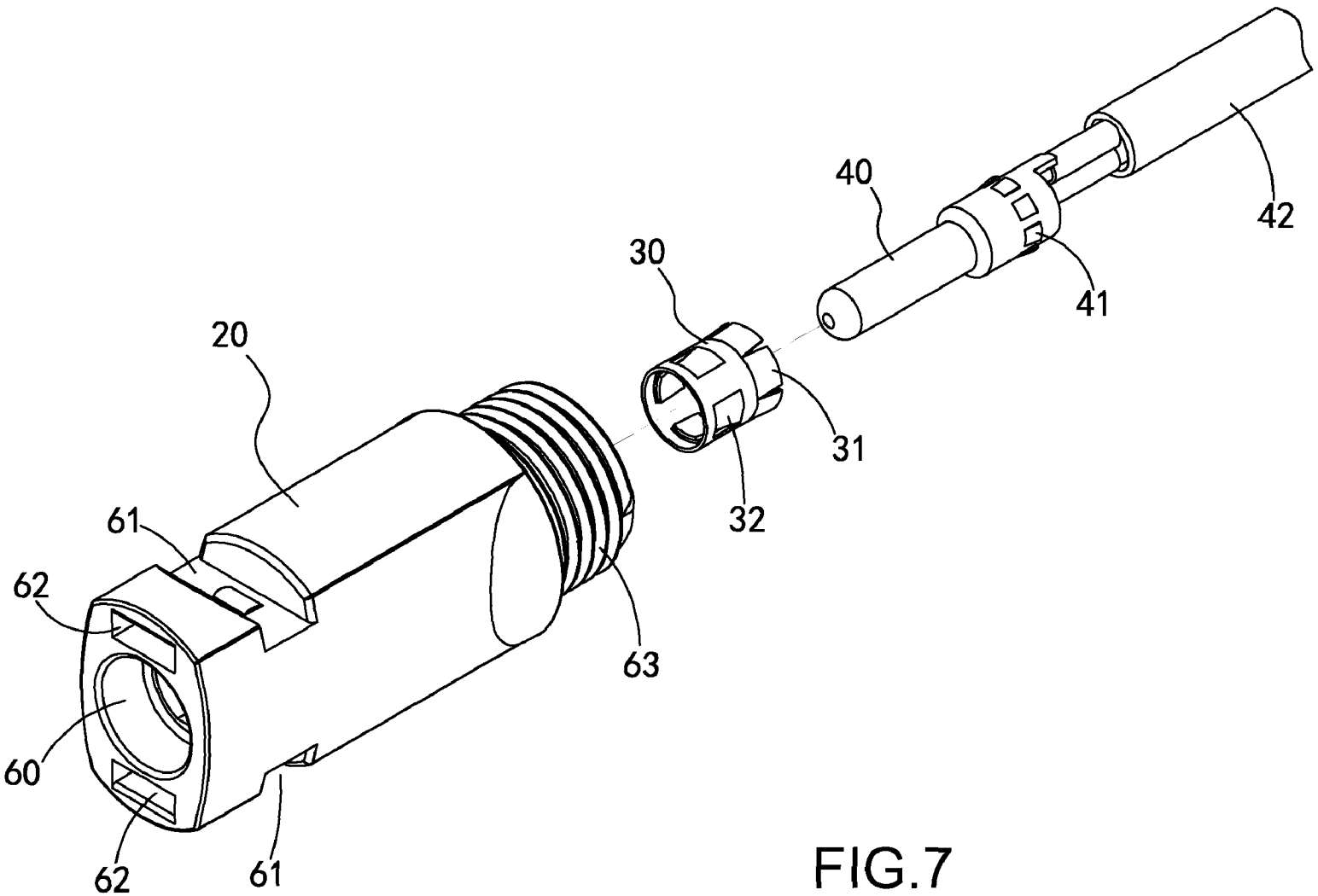
FIG. 7 is an exploded view to show the female connector of the present invention.
Figure 8:
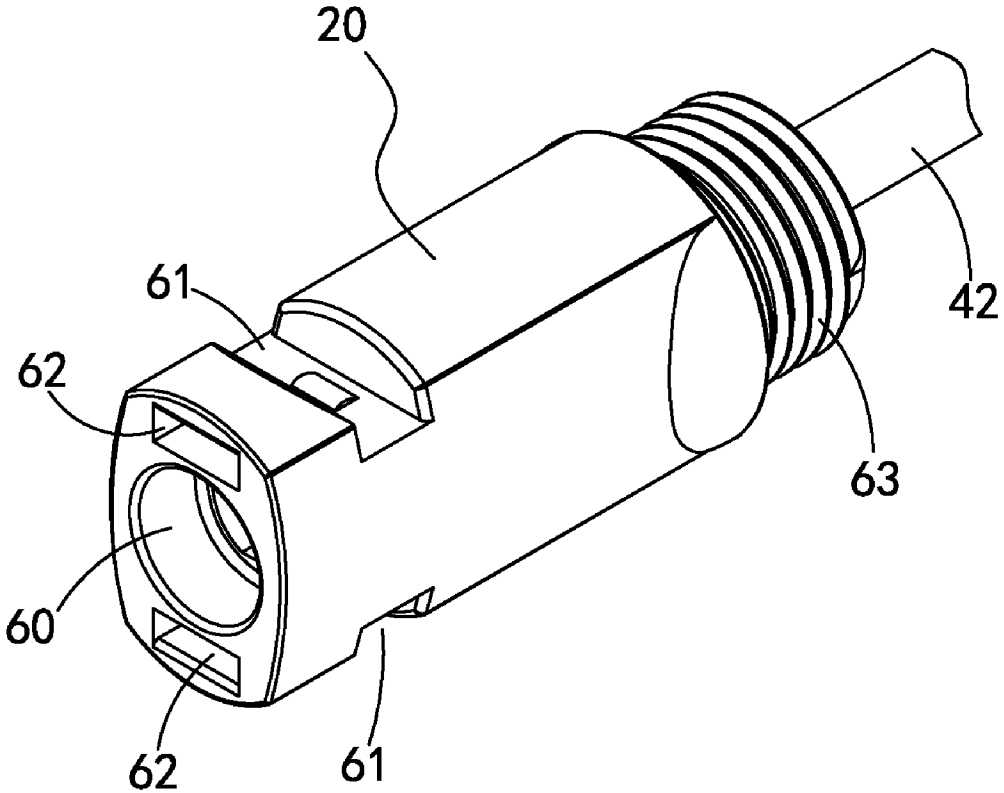
FIG. 8 is a perspective view to show the female connector of the present invention.
Figure 9:
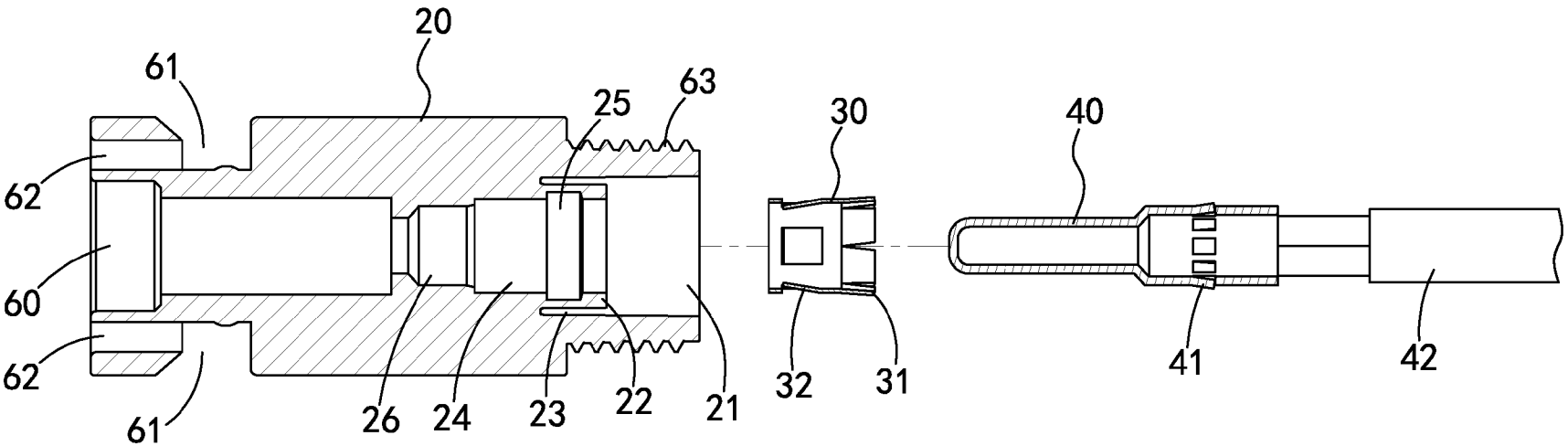
FIG. 9 is a cross sectional view to show the female connector of the present invention.
Figure 10:
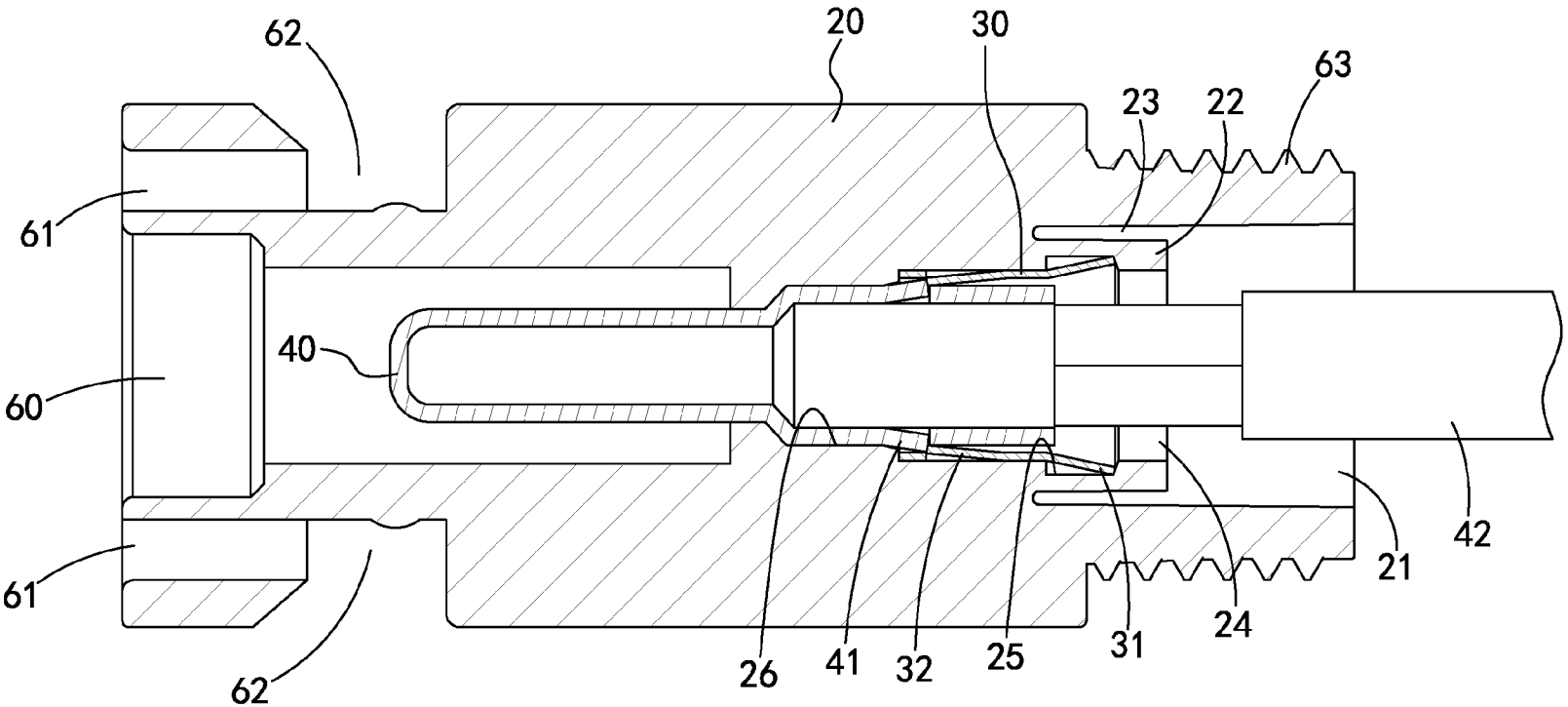
FIG. 10 is an enlarged cross sectional view of the female connector of the present invention.

Referring to FIGS. 3 to 13, the connector of the present invention comprises an insulation body 20, a collar 30 and a terminal 40.

The insulation body 20 has a recess 21 defined in the first end thereof and a protrusion 22 extends from the inner end of the recess 21 so as to form an annular gap 23 between the inner periphery of the recess 21 and the protrusion 22. The protrusion 22 is expandable radially and outward, and returns to its initial position when the expanding force is disappear.

The protrusion 22 has a connection hole 24 defined therethrough and an enlarged groove is defined in the periphery of the connection hole 24 so as to form a shoulder 25. A passage 26 is defined in the second end of the insulation body 20 and communicates with the connection hole 24. The inner diameter of the passage 26 is smaller than that of the connection hole 24.

A conductive member is inserted into the connection hole 24 and the passage 26. In this embodiment, the conductive member comprises the collar 30 and the terminal 40, wherein multiple flexible plates 31 extend inclinedly from the outer periphery of the collar 30 and are engaged with the shoulder 25 to prevent the collar 30 from disengaging from the connection hole 24. Multiple resilient plates 32 extend inclinedly from the periphery of the collar 30 and toward the second end of the collar 30.

The terminal 40 extends through the collar 30 and is inserted into the passage 26. Multiple engaging plates 41 extend inclinedly from the periphery thereof and toward the first end of the terminal 40. When the terminal 40 extends through the collar 30, the engaging plates 41 are engaged with the resilient plates 32 of the collar 30 to prevent the terminal 40 from disengaging from the collar 30. A cable 42 is connected with the first end of the terminal 40.

As shown in FIGS. 3 to 6, the connector is a male connector and the insulation body 20 has a tubular portion 50 extending from the second end thereof. The passage 26 is defined in the tubular portion 60. The insulation body 20 has two hooks 51 extending from the second end thereof and the tubular portion 50 is located between the two hooks 51. The tubular portion 50 has an entrance hole 52 defined in a distal end thereof and the entrance hole 52 communicates with the passage 26. The insulation body 20 has a threaded section 53 defined in an outer periphery of the first end thereof and the outer diameter of the threaded section 53 is smaller than that of the insulation body 20. The terminal 40 has a guide hole 43.

As shown in FIGS. 7 to 10, the connector is a female connector and has an insertion hole 60 defined in the second end thereof and the insertion hole 60 communicates with the passage 26. The tubular portion 50 of the male connector is inserted into the insertion hole 60. The terminal 40 of the female connector is inserted into the insertion hole 60 so that when the tubular portion 50 of the male connector is inserted into the insertion hole 60, the terminal 40 of the female connector is inserted into the guide hole 43 of the terminal 40 of the male connector to form an electrical contact. Two notches 61 are radially defined in an outer periphery of the second end of the insulation body 20 and two engaging holes 62 are defined in the second end of the insulation body 20. The two notches 61 communicate with the two engaging holes 62 so that the two hooks 51 of the male connector are engaged with the engaging holes 62 and the notches 61. The insulation body 20 has a threaded section 63 defined in the outer periphery of the first end thereof, and the outer diameter of the threaded section 63 is smaller than that of the insulation body 20.

Figure 11:
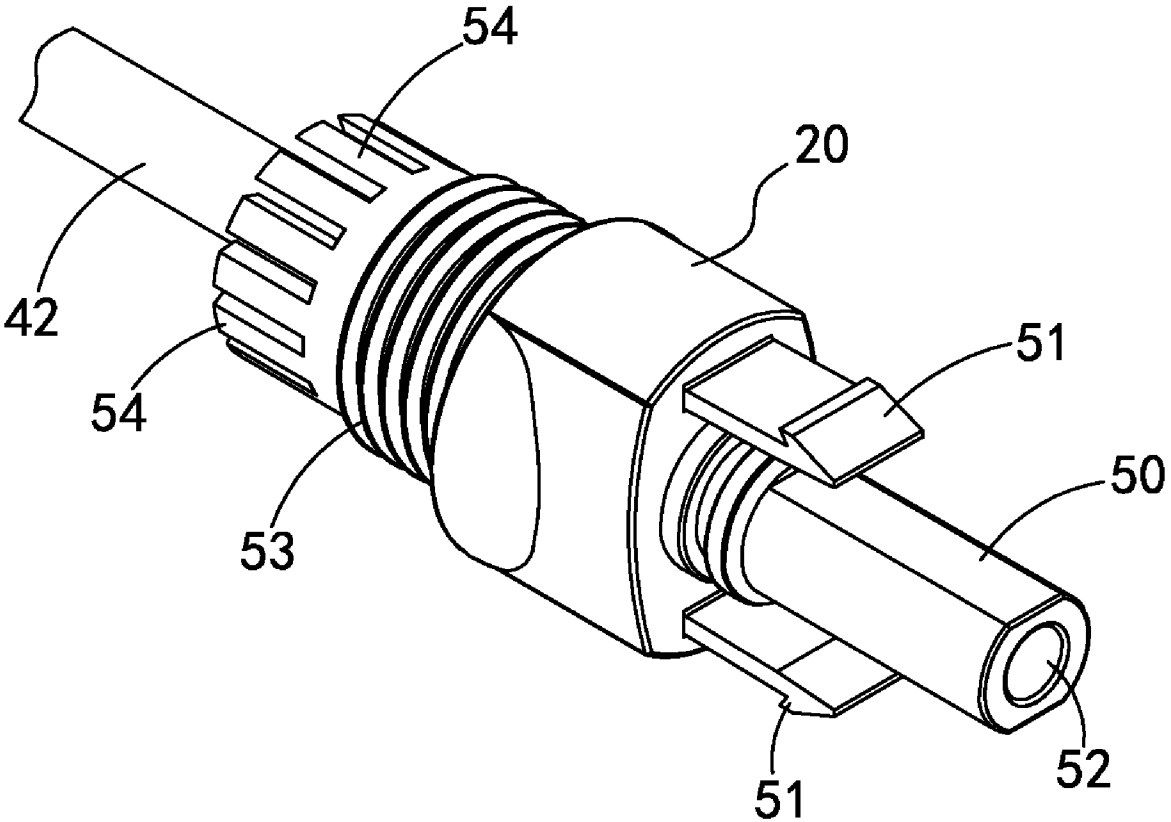
FIG. 11 shows another embodiment of the male connector of the present invention.

FIG. 11 shows another embodiment of the male connector which is the same as that in FIGS. 3 to 6, and the difference is that the insulation body 20 has multiple spaced tabs 54 extending axially from the first end thereof.

Figure 12:
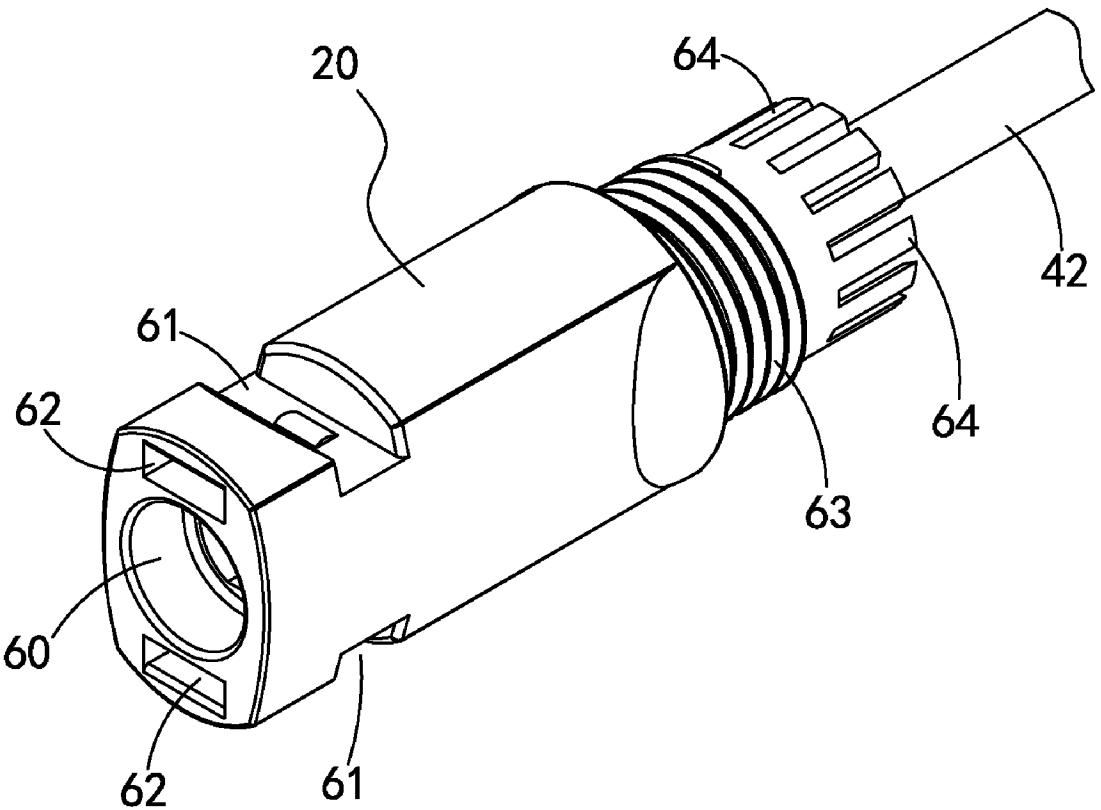
FIG. 12 shows another embodiment of the female connector of the present invention.

FIG. 12 shows another embodiment of the female connector which is the same as that in FIGS. 7 to 10, and the difference is that the insulation body 20 has multiple spaced tabs 64 extending axially from the first end thereof.

In this embodiment, the conductive member comprises the collar 30 and the terminal 40, the conductive member can also be a single part. The flexible plates 31 on the collar 30 can directly be formed on the terminal or the conductive member.

By the annular gap 23 formed between the inner periphery of the recess 21 and the protrusion 22, the protrusion 22 is expandable radially and outward, and the protrusion 22 can return to the initial position, so that the insulation body 20 is easily removed from the mold by the adjustment of the protrusion 22. Furthermore, the deeper enlarged groove can be made so that the flexible plates 31 on the conductive member are firmly engaged with the shoulder 25. The annular gap 23 and the connection hole 24 have thinner wall which shrinks slightly so that the conductive member can be easily positioned and engaged within the connection hole 24.

While we have shown and described the embodiment in accordance with the present invention, it should be clear to those skilled in the art that further embodiments may be made without departing from the scope of the present invention.

What is claimed is:

1. A connector comprising:

an insulation body having a recess defined in a first end thereof and a protrusion extending from an inner end of the recess so as to form an annular gap between an inner periphery of the recess and the protrusion, the protrusion being expandable radially and outward, the protrusion having a connection hole defined therethrough and an enlarged groove defined in a periphery of the connection hole so as to form a shoulder, a passage defined in a second end of the insulation body and communicating with the connection hole, an inner diameter of the passage being smaller than that of the connection hole, and a conductive member inserted into the connection hole and the passage, multiple flexible plates extending inclinedly from an outer periphery of the conductive member and engaged with the shoulder.

2. The connector as claimed in claim 1, wherein the conductive member comprises a collar and a terminal, the collar located in the connection hole and the flexible plates extend inclinedly from a first end of the collar, multiple resilient plates extend inclinedly from a periphery of the collar and toward a second end of the collar, the terminal has multiple engaging plates extending inclinedly from a periphery thereof and toward a first end of the terminal, when the terminal extends through the collar, the engaging plates are engaged with the resilient plates of the collar.

3. The connector as claimed in claim 1, wherein the connector is a male connector and the insulation body has a tubular portion extending from the second end thereof, the passage is defined in the tubular portion, the tubular portion has an entrance hole defined in a distal end thereof and the entrance hole communicates with the passage, the terminal has a guide hole.

4. The connector as claimed in claim 3, wherein the insulation body has two hooks extending from the second end thereof and the tubular portion is located between the two hooks.

5. The connector as claimed in claim 4, wherein the insulation body has a threaded section defined in an outer periphery of the first end thereof, an outer diameter of the threaded section is smaller than that of the insulation body.

6. The connector as claimed in claim 5, wherein the insulation body has multiple spaced tabs extending axially from the first end thereof.

7. The connector as claimed in claim 1, wherein the connector is a female connector and has an insertion hole defined in the second end thereof and the insertion hole communicates with the passage, the conductive member is inserted into the insertion hole.

8. The connector as claimed in claim 7, wherein two notches are radially defined in an outer periphery of the second end of the insulation body and two engaging holes are defined in the second end of the insulation body, the two notches communicate with the two engaging holes.

9. The connector as claimed in claim 8, wherein the insulation body has a threaded section defined in an outer periphery of the first end thereof, an outer diameter of the threaded section is smaller than that of the insulation body.

10. The connector as claimed in claim 9, wherein the insulation body has multiple spaced tabs extending axially from the first end thereof.

* * * * *